US005950476A

United States Patent [19]

Brashear

[11] Patent Number: 5,950,476

[45] Date of Patent: Sep. 14, 1999

[54] METHOD AND APPARATUS TO TENSION HOT STRIP DURING COILING

[75] Inventor: Joseph Oscar Brashear, Glenshaw, Pa.

[73] Assignee: SMS Engineering, Inc., Pittsburgh, Pa.

[21] Appl. No.: 09/045,318

[22] Filed: Mar. 20, 1998

[51] Int. Cl.[6] ..... B21B 39/08; B21C 47/00

[52] U.S. Cl. ..... 72/205; 72/146

[58] Field of Search ..... 72/146, 148, 205, 72/229, 161, 163, 11.4, 12.3, 183, 234, 164

[56] References Cited

U.S. PATENT DOCUMENTS

| | | | |
|---|---|---|---|
| 4,074,555 | 2/1978 | Noe | 72/163 |
| 4,316,376 | 2/1982 | Masui et al. | 72/161 |
| 4,809,528 | 3/1989 | Lawson et al. | 72/205 |
| 5,540,074 | 7/1996 | Smith et al. | 72/229 |
| 5,701,774 | 12/1997 | Imanari et al. | 72/11.4 |

*Primary Examiner*—Rodney Butler
*Attorney, Agent, or Firm*—Clifford A. Poff

[57] ABSTRACT

The present invention is to tension and guide hot strip for coiling in a hot strip mill, the hot strip mill includes a runout table with driven rollers for delivering hot strip from a train of finishing mill stands along a pass line of a runout table to a coiler. The coiler having driven mandrel for coiling strip thereon and pinch rolls having an operative position to direct the leading end of strip from the runout table to the coiler and tension the deflected leading end portion of strip during the formation of initial convolutions of coiled strip on the driven mandrel. Gag roll assembly upstream of the pinch rolls at the runout table for tensioning strip conveyed by the runout table after a trailing strip end emerges from the train of finishing mill stands. An actuator moves the gag roll assembly from an inoperative position remote to the pass line on the runout table into an operative position wherein strip is deflected from the pass line sufficiently to partly wrap about a roll face surface of the gag roll thereby tensioning the strip during coiling. The gag rolls are driven by motors to maintain a synchronous speed relation between the rolls surface of the gag roll and the speed of the strip to avoid scratching or marking of the strip.

26 Claims, 6 Drawing Sheets

METHOD AND APPARATUS TO TENSION HOT STRIP DURING COILING

BACKGROUND OF THE INVENTION

1. Field of the Invention

The present invention relates to a method and apparatus for coiling hot strip delivered by a runout table from hot strip finishing mill stands and, more particularly, the present invention provides for strip stabilizing and the control of strip tension during the coiling operation after the leading end portion of the strip is wrapped sufficiently to establish driving engagement with the coiler and the trailing portion is discharged from the finishing mill stands.

2. Description of the Prior Art

The present invention is particularly useful in a continuous hot strip mill and in a thin strip continuous casting facility where the hot cast strip is rolled in a train of finishing mill stands. It is a common practice in a continuous hot strip mill to deliver the strip from the finishing mill stands by a runout table provided with water sprays to cool the strip before coiling by a coiler commonly referred to a downcoiler. The hot strip is advanced by the runout table along a pass line where driven pinch rolls at opposite sides of the pass line engage and deflect the strip downwardly between guides to the surface of a coiler manual. In the past, when the trailing end of the strip was undergoing finish rolling operations in the finishing mill stands, the drive motors for the finishing stands were used to control the tensioning in the strip once the strip was coiled sufficiently to establish driving engagement at the coiler. After the trailing strip portion emerged from the finishing stands, tension control was lost and the pinch rolls were used to control tension in the strip between the pinch rolls and coiler. However, because the pinch rolls performed the necessary function of deflecting the strip from the pass line through the guide chute of the downcoiler, the rotational axis of the top pinch roll is horizontally offset in a direction downstream along the pass line from the rotational axis of the bottom pinch roll. During the time the pinch rolls were used to tension the strip, there exists a problem of providing a steering control to correct for unwanted strip movement. The hot strip emerging from the finishing stands has thickness irregularities both longitudinally and transversely. Because of these irregularities, tensioning by the pinch rolls is difficult to control. A pressure different in magnitude is sometimes applied to the opposite ends of the top pinch roll to vary the pressure across the nip for steering the strip. Strip steering is adversely affected by the strip irregularities that almost always change from front to back and usually randomly along increments of strip length. It has been found that engaging the strip in the nip of the pinch rolls adversely effects the use of the differential pressure control on the top pinch roll to steer the strip.

It is also known in the art to provide a continuous strip caster for supplying a continuous casting of thin relatively wide steel strip, typically such strip is up to 120" wide and between 1½" to 2½" thick. The cast strip is cooled by water sprays in the caster and as the strip emerges from the caster, it is fed directly into a furnace to heat the strip to a rolling temperature. The cast strip is sheared into suitable lengths for producing coils of a desired sizes. At the discharge end of the furnace, the thin cast strip enters the first rolling mill stand of tandem arrangement of rolling mill stands forming a finishing mill train, which reduce the thickness of the strip to a desired thickness. The strip is conveyed from the finishing mill train by a runout table having water sprays there along to cool the strip before coiling. The strip is fed from the runout table to a coiler. The problems encountered in the delivery of the hot strip by a continuous hot strip mill for coiling are similarly encountered incident to the coiling of the strip produced by a continuous caster using the reheat furnace and the tandem finishing mill train. A need therefore, exists for an arrangement to control tensioning of the hot strip during coiling in a manner that will stabilize the strip while advanced along the pass line to a coiler.

Therefore it is an object of the present invention to provide a strip stabilizing and tensioning arrangement for hot strip during coiling.

It is a further object of the present invention to provide an arrangement of at least one driven roll which can cooperate with driven rolls in a runout table to deflect the strip from the pass line in a way for causing a driven roller that is downstream of the roller used to deflect the strip, to lift the strip and establish driving contact sufficient to tension the strip between the deflecting roller and the upstream roller at the pass line.

It is still a further object of the present invention to provide a gag roll arrangement to stabilize and tension the strip without the establishment of a nip by the gag rolls.

It is another object of the present invention to position a driven gag roll in contact with strip to cause deflection of the strip from a pass line and cause the strip to wrap about the roll surface by an amount sufficient to establish tension control of the strip between the gag roll and forwardly to a coiler for the strip.

It is another object of the present invention to controllably position a driven gag roll in contact with strip to cause the strip to deflect at an angle from a pass line and thereby guide the strip delivered to a coiler for coiling.

SUMMARY OF THE INVENTION

According to the present invention there is provided a strip tensioning and stabilizing apparatus to tightly wind strip delivered from a hot strip finishing mill on a coiler, the apparatus including a coiler having an entrance along a pass line to receive strip conveyed by spaced apart driven rollers downstream from such a hot strip finishing mill, a gag roll proximate the entrance to the coiler for deflecting the strip from the pass line between the spaced apart drive rollers and thereby effect tight winding of the strip by the coiler, and a positioner for moving the gag roll from an inoperative position remote to the pass line to an operative position intercepting and deflecting the strip from the to tension pass line at the entrance to the coiler to tension for tight winding of the strip during coiling.

The present invention further provides a method for tight winding hot strip delivered from a train of finishing mill stands along a pass line of a runout table to a coiler, the method includes the steps of deflecting the leading end of hot strip by a pinch roll assembly while advanced along the pass line to the coiler, creating a first strip tension zone between the pinch roll assembly and a coiler mandrel of the coiler while the strip issues from the last finishing stand, after the strip exits the last finishing stand to contain tight winding a second strip tension zone is created between the coiler mandrel and a gag roll, the second strip tension zone being formed by deflecting the strip relative to the pass line by engagement with the gag roll.

According to a further feature of the present invention there is provided an apparatus to tight wind strip in a hot strip mill, the hot strip mill including a runout table having spaced apart driven rollers for delivering hot strip from a train of finishing mill stands along a pass line of a runout table to a downcoiler, the downcoiler having a driven mandrel for coiling strip thereon and a pinch roll having an operative position to deflect a leading end of strip from the pass line of the runout table to the downcoiler and tension a leading portion of strip during the formation of initial convolutions of strip on the mandrel, the apparatus includes a gag roll proximate the pinch roll at the runout table for tensioning strip conveyed by the runout table after a trailing strip end emerges from the train of finishing mill stands, an actuator for moving the gag roll from an inoperative position remote to the pass line on the runout table into an operative position wherein the gag roll engages and deflects the strip from the pass line sufficiently to partly wrap strip about a roll face surface of the gag roll thereby tensioning for tight winding the strip during coiling, and a motor coupled to drive the gag roll while in contact with the strip.

BRIEF DESCRIPTION OF THE DRAWINGS

The present invention will be more fully understood when the following description is read in light of the accompanying drawings in which.

DETAILED DESCRIPTION OF THE DRAWINGS

Figure 1:
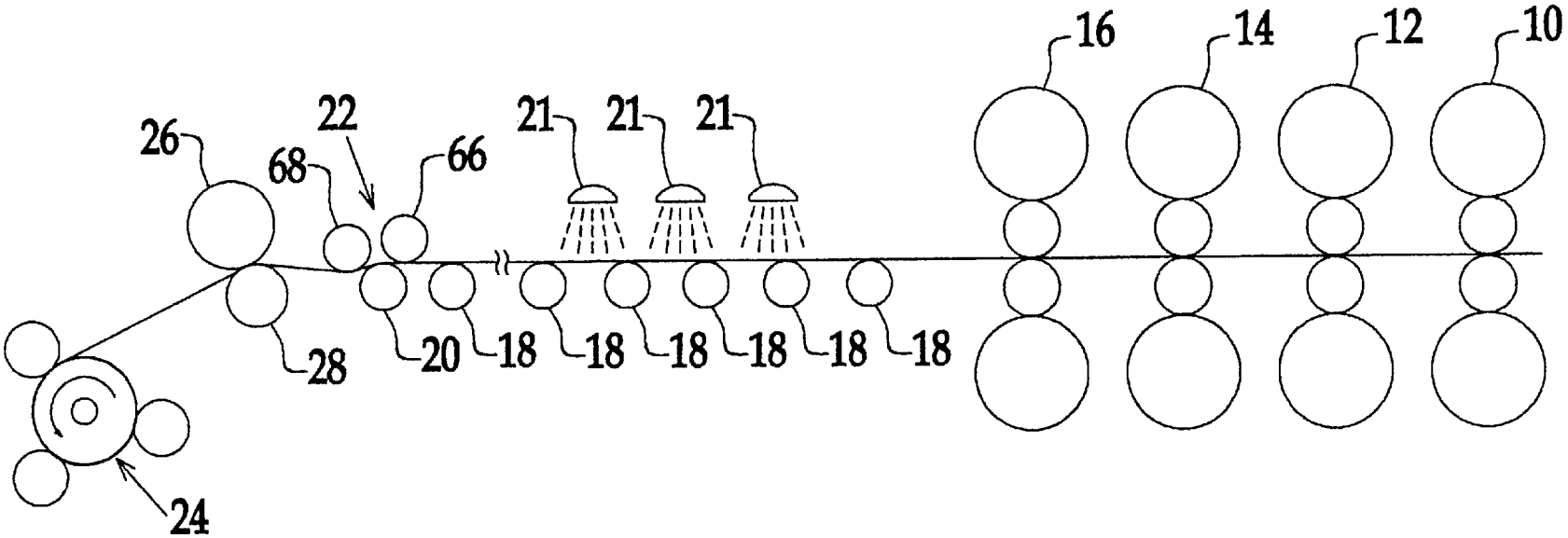
FIG. 1 is a schematic illustration of a finishing mill train and runout table including the gag roll arrangement according to the present invention for acting on hot strip during coiling.

FIG. 1 schematically illustrates a tandem arrangement of finishing mill stands 10, 12, 14 and 16 which receive heated strip for reduction to a desired thickness. The finishing mill train may form part of a hot strip mill installation or part of a thin strip continuous casting installation. The strip issuing from the last mill stand 16 passes along a runout table where it is supported by driven table rollers 18 and a driven housing roller 20 while coolant water is discharged from spray heads 21 for cooling the strip. The last table roller 18 and the driven housing roller 20 cooperatively associate with a pivotally supported gag roll assembly 22 to guide and tension the strip during coiling in a downcoiler 24. A top pinch roll 26 is moved into an operative position with respect to a lower pinch roll 28 for deflecting and feeding the leading end of a strip to the downcoiler 24.

Figure 2:
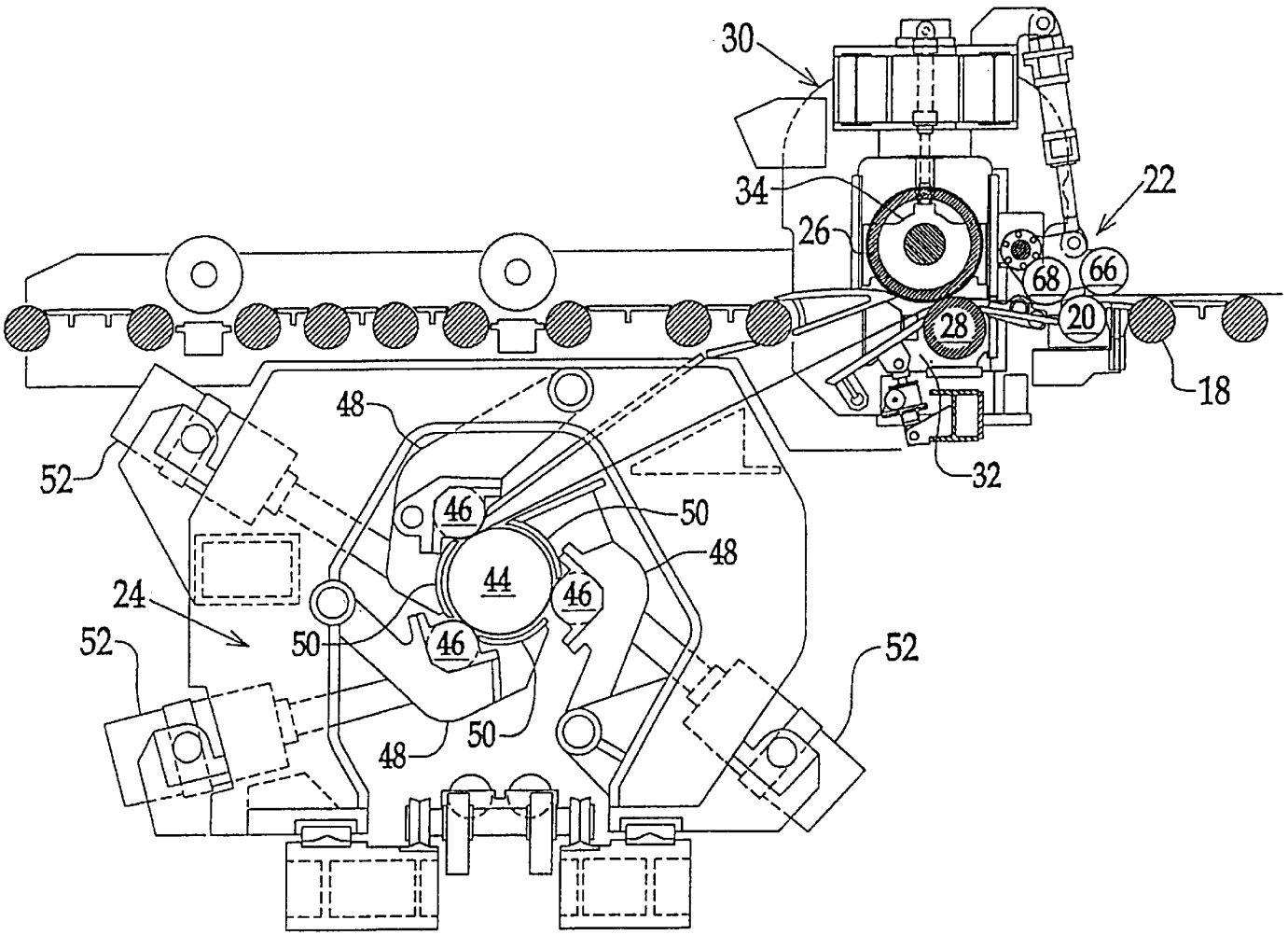
FIG. 2 is an enlarged elevational view of the gag roll arrangement and coiler shown in FIG. 1.

The pinch rolls 26 and 28 are supported in a pinch roll housing 30 as shown FIG. 2. Bearing block assemblies 32 mounted on opposite ends of the lower pinch roll 28 are received in the housing window opening and supported by pinch roll housing 30. Similarly, bearing block assemblies 34 mounted on opposite ends of the pinch roll 26 are received in the housing window opening and supported by the pinch roll housing 30.

A piston and cylinder assembly 36 for each bearing block assembly 34 is operated to raise the upper pinch roll into an inoperative position and lower it into an operative position. In the operative position shown in FIG. 3, the upper pinch roll 26 rotates about an axis that is advanced downstream along the pass line from the rotational axis of the lower pinch roll 28. With the upper pinch roll in an operative position, the leading end of the strip is engaged between the pinch rolls and deflected downwardly into a throat 38 formed by upper and lower guides 40 and 42, respectively. As illustrated in FIG. 2, the throat of the downcoiler extends to a coiler mandrel 44 that is rotatably driven in a conventional manner by a drive motor and spaced about the periphery of the coiler mandrel are three guide rollers 46 each supported by pivotally mounted arms 48 that carry arcuate shaped guides 50. The guide rollers 46 are moved into an operative position shown in FIG. 2 by an associated piston and cylinder assembly 52 and after initial wraps of strip have been formed on the mandrel, the piston and cylinder assemblies 52 are operated to retract the guide rollers 46 to an inoperative site which provides the needed space for the formation of a coil of a desired size.

Figure 5:
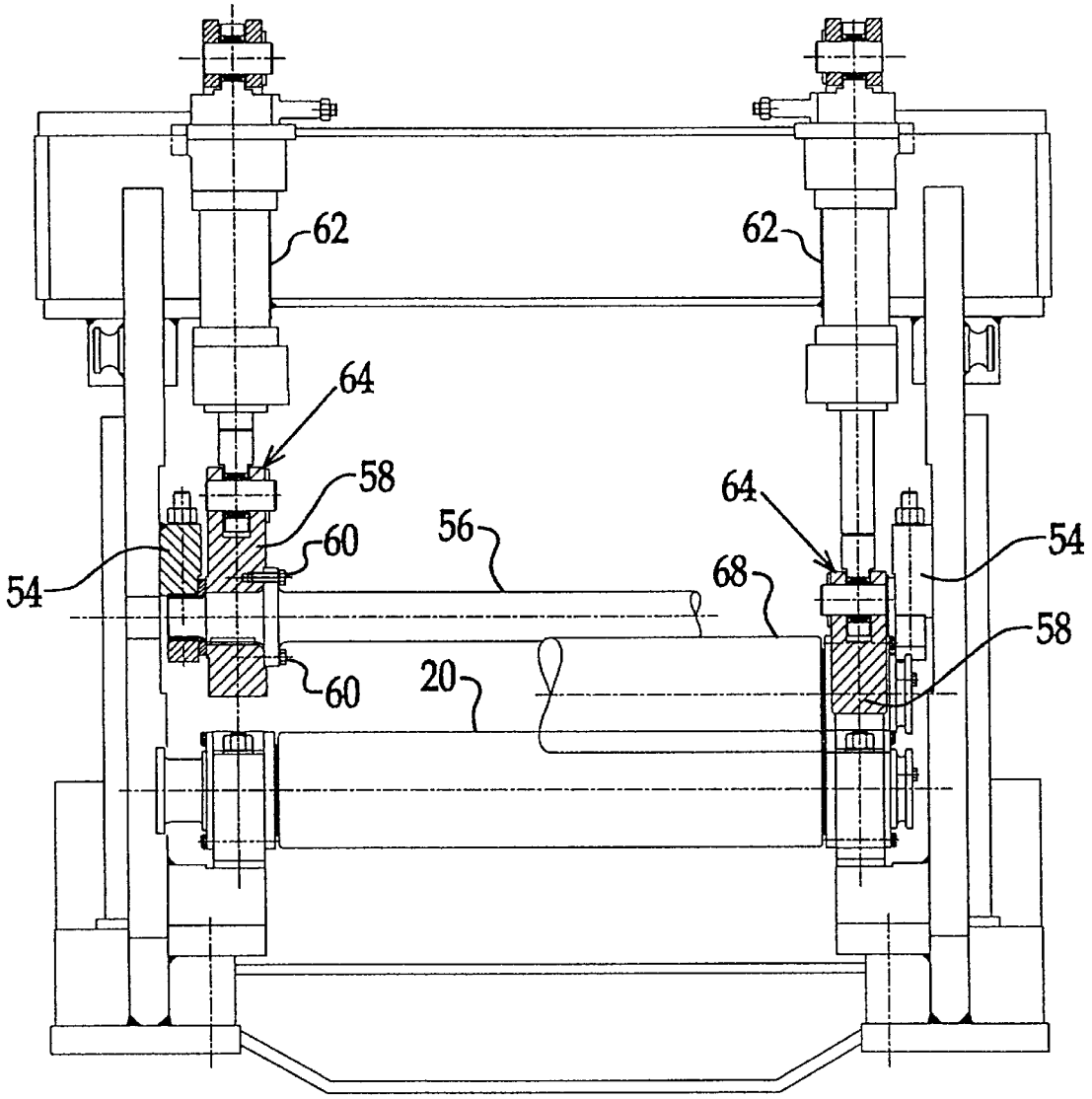
FIG. 5 is an elevational view taken along the lines of V—V of FIG. 4.
Figure 6:
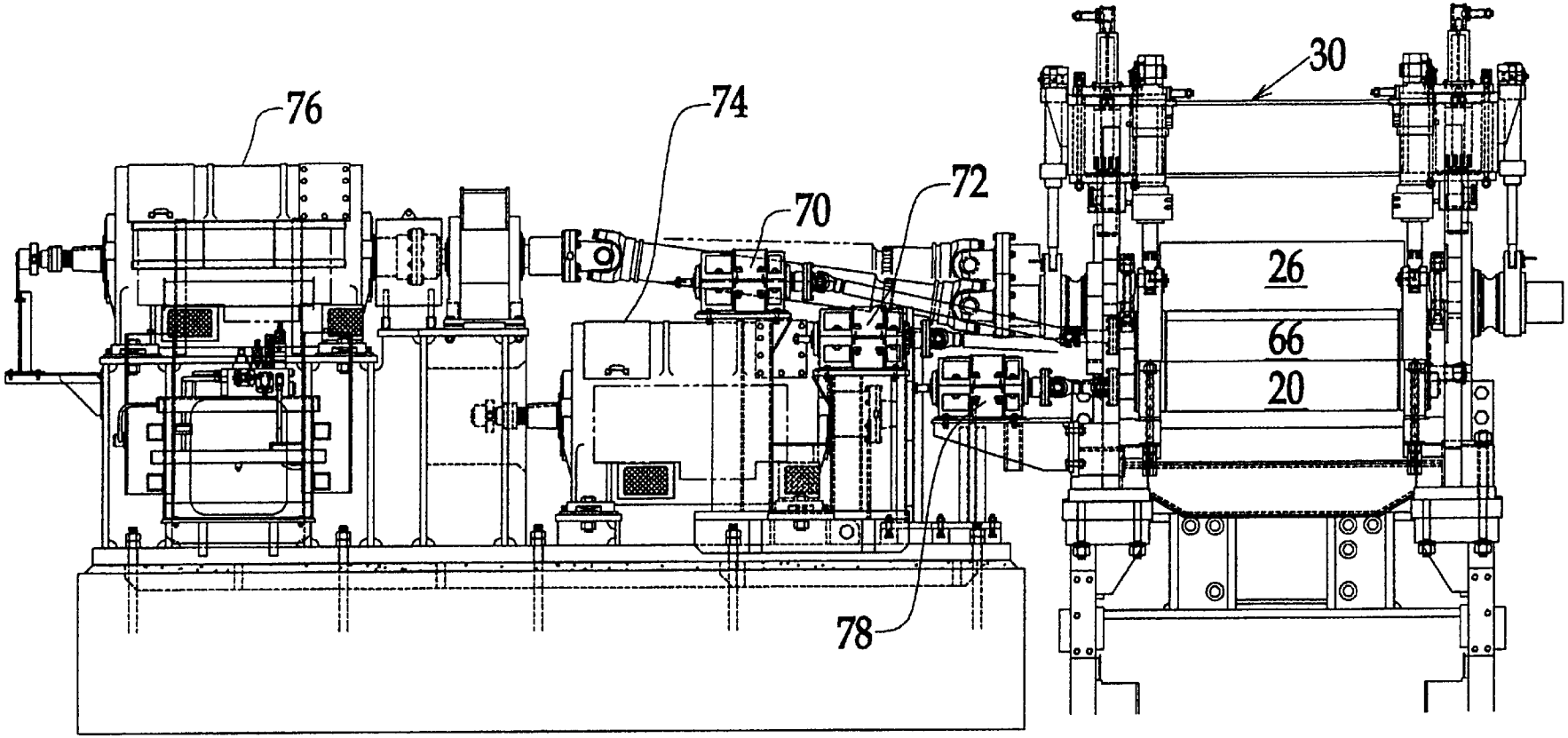
FIG. 6 is a view similar to FIG. 5 and illustrating the drive arrangement for the gag rolls and pinch rolls.

The gag roll assembly 22 is shown in greater detail in FIG. 5 and includes a bearing block 54 secured to each of opposed vertical columns of the pinch roll housing 30. The bearing blocks 54 support opposite ends of a torque shaft 56. Adjacent each bearing block 54 is a pivot arm 58 which is mounted on the torque shaft and secured to the pivot arm by bolts 60 extending through a flange formed on the torque shaft into tapped holes provided in the body of the pivot arm. Each pivot arm is connected to the rod end of a piston and cylinder assembly 62 by a clevis mounting assembly 64. The pivot arms 58 support spaced apart bearing assemblies that rotatably support the ends of gag rolls 66 and 68. As shown in FIG. 6, drive motors 70 and 72 are connected by spindles to the gag rolls 66 and 68, respectively. Also illustrated are drive motors 74 and 76 for the upper and lower pinch rolls, respectively, and a drive motor 78 for the housing roll 18.

Referring again to FIG. 1, as the leading end of the strip after rolling in the finishing mill train engages the pinch rolls, the length of strip between the pinch rolls 26 and 28 and the last finishing stand 16 is tensioned by the drive motors for the pinch rolls. At the same time, because the upper pinch roll is offset from the lower pinch roll, the leading end of the strip is deflected downwardly into the throat 38 of the downcoiler and, through operation of the downcoiler, initial wraps are formed on the mandrel. After sufficient convulsions of strip are formed on the mandrel to establish a driving relationship, the top pinch roll 26 is lifted vertically out the engagement with the strip whereupon tension in the strip between the last finishing stand 16 and the coiler mandrel is controlled by the drive motor for the coiler mandrel. This tensioning of the strip initially between the pinch roll and the coiler mandrel and then between the finishing rolling mill stands and coiler mandrel assures the formation of tightly wrapped convulsions of strip.

Figure 3:
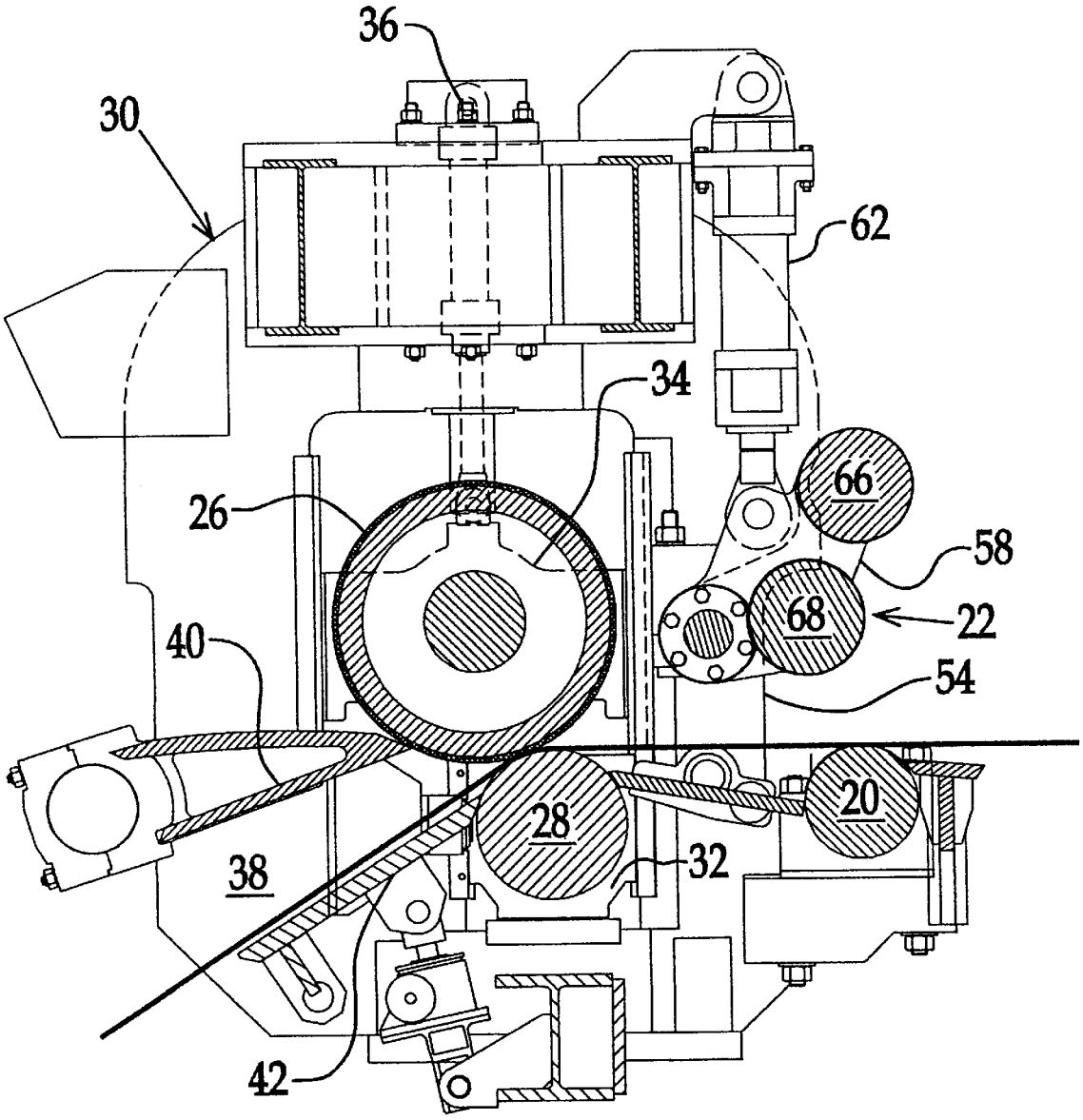
FIG. 3 is an enlarged elevational view in section illustrating the gag roll arrangement in an inoperative position.
Figure 4:
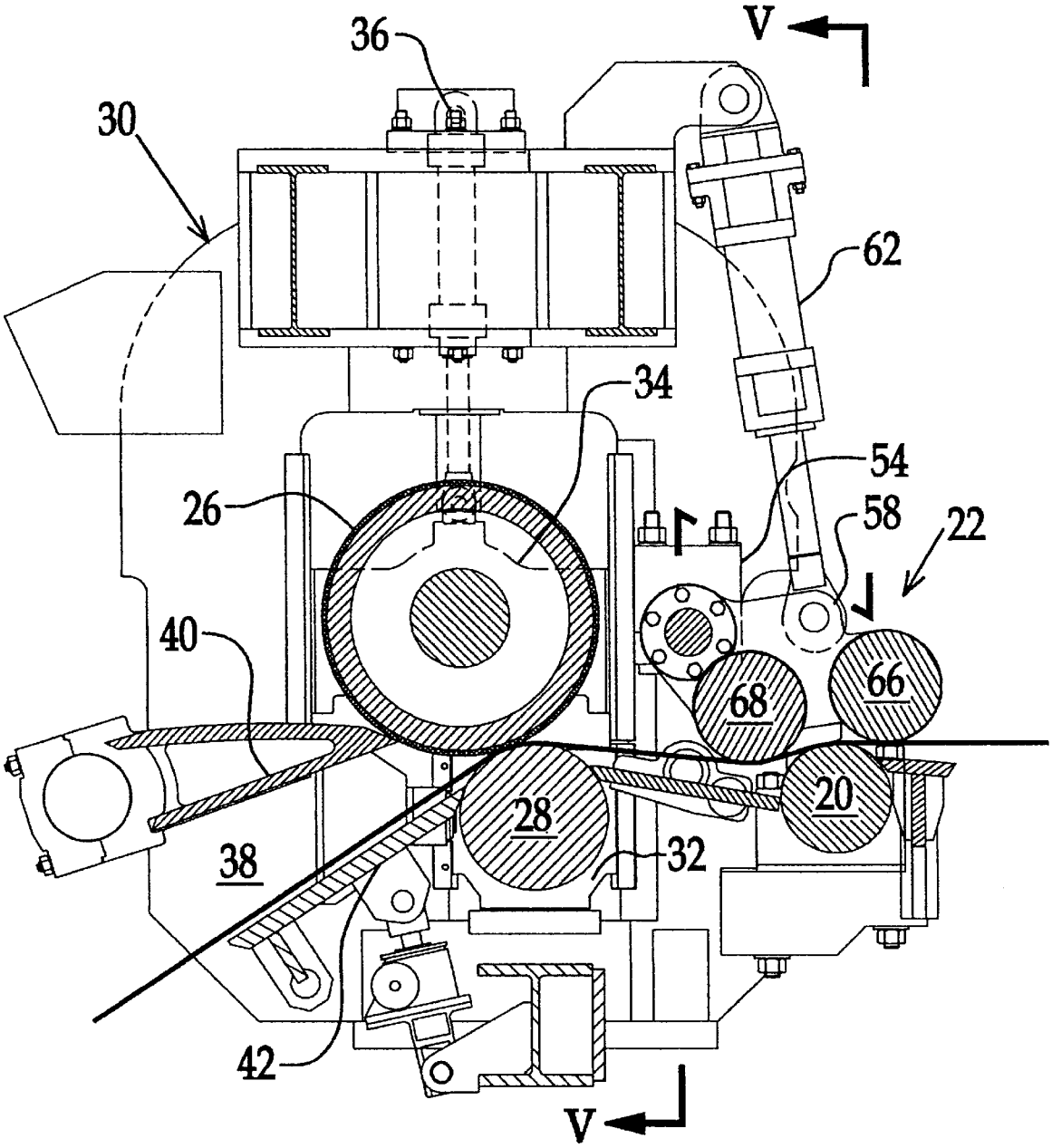
FIG. 4 is an enlarged elevational view in section illustrating the gag roll arrangement in an operative position.

According to the present invention, the gag roll assembly 22 is moved from an inoperative position shown in FIG. 3 to an operative position shown in FIG. 4 to establish tension control and to stabilize the strip upon the emergent of the trailing end of the strip from the finishing mill stand 16. Dependent on the thickness of the strip, in the operative position the gag roll 66 typically will engage the top surface of the strip without deflecting the strip from the pass line. The undersurface of the strip is engaged and supported by the driven housing roll 18 at a site immediately downstream from gag roll 66. Downstream of the driven housing roll 18 is gag roll 68 which is carried on the pivot arms 58 such that the cylindrical surface of the gag roll extends below the pass line thus deflecting the strip between the housing roller 18 and the lower pinch roll 28. The lower pinch roll functions to lift the strip to the pass line. The deflection of the strip by gag roll 68 is accompanied by the bending of the strip to partly wrap about the surface of the gag roll 68 and the extent of the partial wrapping can be controlled to control the amount of the strip tension that is imposed on the strip between the gag roll 68 and the coiler mandrel 44. The speed of the gag rolls when brought into contact with the strip, is most advantageously synchronized with the speed of the strip to avoid scratching or other marking of the strip surface. As the trailing portion of the strip advances along the runout table toward the downcoiler, the piston and cylinder assemblies 62 are differentially controlled to cause one end portion of the gag roll to be positioned differently e.g. closer than the other end portions relative to the pass line. This differential positioning of the ends of the gag rolls is enabled by the provision of the torque shaft 56 which interconnects the pivot arms with bearing blocks 54 and accommodates relatively different positions of the pivot arms. Strip irregularities as discussed hereinbefore, do not adversely affect the operation of the gag rolls to tension and steer the strip since these functions are derived without the formation of a nip between the rolls. The partially wrapped engagement with the strip by the gag roll is not affected by thickness variations to the strip from front to back or transversely. The tensioning control by the gag roll arrangement is not affected by transverse crown or other thickness variations to the strip. While gag rolls 66 and 68 have been illustrated and described to carry out the purpose of the gag roll assembly of the present invention, it is to be understood that gag roll 66 has been included to optimize the results according to the invention but may be eliminated without departing from the spirit of the invention, since the favorable benefits of the present invention are obtained by the partial wrapping of the strip about the surface of the gag roll arranged to deflect the strip from the pass line. It is therefore sufficient to utilizes only gag roll 68.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. Apparatus to tension hot strip for coiling in a hot strip mill, said hot strip mill including a runout table having spaced apart driven rollers for delivering hot strip from a train of finishing mill stands along a pass line of a runout table to a coiler, said coiler having a driven mandrel for coiling strip thereon and pinch rolls having an operative position to direct the leading end of strip from the said runout table to said coiler and tension the deflected leading end portion of strip during the formation of initial convolutions of coiled strip on said mandrel, said apparatus including:

a gag roll upstream of said pinch rolls at the runout table for tensioning strip conveyed by the runout table after a trailing strip end emerges from the train of finishing mill stands;

an actuator for moving said gag roll from an inoperative position remote to said passline on the runout table into an operative position wherein strip is deflected from the passline sufficiently to partly wrap about a roll face surface of said gag roll thereby tension the strip during coiling, said gag roll comprising spaced apart rollers operatively positioned in an up stream location and a down stream location to one of said spaced apart driven rollers while supporting the strip; and a motor coupled to drive said gag roll while in contact with the strip.

2. Apparatus to tension hot strip for coiling in a hot strip mill, said hot strip mill including a runout table having spaced apart driven rollers for delivering hot strip from a train of finishing mill stands along a pass line of a runout table to a coiler, said coiler having a driven mandrel for coiling strip thereon and pinch rolls having an operative position to direct the leading end of strip from the said runout table to said coiler and tension the deflected leading end portion of strip during the formation of initial convolutions of coiled strip on said mandrel, said apparatus including:

a gag roll upstream of said pinch rolls at the runout table for tensioning strip conveyed by the runout table after a trailing strip end emerges from the train of finishing mill stands, a pinch roll assembly including a lower pinch roll operative for lifting the strip to the passline after deflection by said gag roll;

an actuator for moving said gag roll from an inoperative position remote to said passline on the runout table into an operative position wherein strip is deflected from the passline sufficiently to partly wrap about a roll face surface of said gag roll thereby tension the strip during coiling; and a motor coupled to drive said gag roll while in contact with the strip.

3. Apparatus to tight wind strip in a hot strip mill, said hot strip mill including a runout table having spaced apart driven rollers for delivering hot strip from a train of finishing mill stands along a passline of a runout table to a coiler, said coiler having driven mandrel for coiling strip thereon and pinch rolls having an operative position to deflect a leading end of strip from the passline of said runout table to said coiler and tension a leading portion of strip during the formation of initial convolutions of strip on said mandrel, said apparatus including:

a gag roll proximate said pinch rolls at the end of the runout table for tensioning strip conveyed by the runout table after a trailing strip end emerges from the train of finishing mill stands;

an actuator for moving said gag roll from an inoperative position remote to said passline on the runout table into an operative position wherein said gag roll engages and deflects the strip from the passline sufficiently to partly wrap strip about a roll face surface of said gag roll thereby tensioning for tight winding the strip during coiling; and a motor coupled to drive said gag roll while in contact with the strip.

4. The apparatus according to claim 3 wherein said actuator includes piston and cylinder assemblies for positioning said gag roll to control wrap of the strip partly about a roll face of said gag roll.

5. The apparatus according to claim 3 wherein said actuator includes piston and cylinder assemblies for differentially positioning said gag roll to steer the strip while partly wrapped about a roll face of said gag roll.

6. The apparatus according to claim 3 wherein said motor coupled to drive said gag roll synchronizes a surface speed of said gag roll with a speed of the strip contacting said gag roll.

7. The apparatus according claim 3 wherein said coiler comprises a downcoiler.

8. The apparatus according to claim 3 wherein said gag roll comprises spaced apart rollers operatively positioned in an up stream and down stream location to one of said spaced apart driven rollers while supporting the strip.

9. The apparatus according to claim 3 wherein said pinch rolls include a lower pinch roll operative for lifting the strip to the passline after deflection by said gag roll.

10. A method for coiling hot strip delivered from a train of finishing mill stands along a passline of a runout table to a coiler, said method including the steps of:

deflecting a leading end of hot strip by a pinch roll assembly while advanced along the passline to the coiler;

creating a first strip tension zone between said pinch roll assembly and a coiler mandrel of said coiler;

creating a second strip tension zone between the coiler mandrel and a gag roll, said second strip tension zone being formed by deflecting the strip relative to the pass line by engagement with the gag roll;

driving said gag roll about a longitudinal axis to form a synchronized speed relation between a strip engaging surface of the gag roll and the strip advanced along the pass line; and preventing marking of the strip surface by establishing said synchronized speed relation before contact between the gag roll and the strip.

11. A method for tight winding hot strip delivered from a train of finishing mill stands along a passline of a runout table to a coiler, said method including the steps of:

deflecting a leading end of hot strip by a pinch roll assembly while advanced along the passline to the coiler;

creating a first strip tension zone between said pinch roll assembly and a coiler mandrel of said coiler while the strip issues from the last finishing stand;

after the strip exits the last finishing stand to contain tight winding a second strip tension zone is created between the coiler mandrel and a gag roll, said second strip tension zone being formed by deflecting the strip relative to the passline by engagement with the gag roll.

12. The method according to claim 11 including the further step of controlling the amount of bending of the strip that wraps partly about a surface of the gag roll to control the amount of strip tension in said second strip tension zone.

13. The method according to claim 11 including the further step of driving said gag roll about a longitudinal axis to form a synchronized speed relation between a strip engaging surface of the gag roll and the strip advanced along the pass line.

14. The method according to claim 11 including the further step of positioning said gag roll to cause the strip to partly wrap about a surface of a gag roll and guide the strip issuing beyond the gag roll.

15. The method according to claim 11 including the further step of arranging a further gag roll to support an upper surface of the strip at the passline before deflection of the strip from the passline.

16. The method according to claim 13 including the further step of preventing marking of the strip surface by establishing said synchronized speed relation before contact between the gag roll and the strip.

17. A strip tensioning and stabilizing apparatus to tightly wind strip delivered from a hot strip finishing mill on a coiler, said apparatus includes:

a coiler having an entrance along a pass line to receive strip conveyed by spaced apart driven rollers downstream from such a hot strip finishing mill;

a gag roll proximate the entrance to said coiler for deflecting the strip from the passline between said spaced apart drive rollers and thereby effect tight winding of strip by the coiler; and a positioner for moving the gag roll from an inoperative position remote to the passline to an operative position intercepting and deflecting the strip from the passline at the entrance to said coiler to tension for tight winding of the strip during coiling.

18. The apparatus according to claim 17 wherein said positioner includes piston and cylinder assemblies for positioning said gag roll to control wrap of the strip partly about a roll face of said gag roll.

19. The apparatus according to claim 17 wherein said positioner includes piston and cylinder assemblies for differentially positioning said gag roll to steer the strip while partly wrapped about a roll face of said gag roll.

20. The apparatus according to claim 17 further including a drive operatively coupled to said gag roll to synchronize a surface speed of said gag roll with a speed of the strip contacting said gag roll.

21. The apparatus according to claim 17 further including a further driven roller member for lifting the strip to the passline after deflection by said gag roll.

22. The apparatus according to claim 17 wherein said gag roll comprises spaced apart rollers operatively positioned in an up stream and down stream location to one of said spaced apart driven rollers while supporting the strip.

23. The apparatus according to claim 21 wherein said further driven roller member comprises a lower pinch roller.

24. A strip tensioning and stabilizing apparatus to tightly wind strip delivered from a hot strip finishing mill on a coiler, said apparatus including:

spaced apart driven rollers for advancing strip along a passline downstream from such a hot strip finishing mill;

a gag roll for deflecting the strip from the passline between said spaced apart drive rollers, said gag roll comprising spaced apart rollers operatively positioned in an up stream location and a down stream location to one of said spaced apart driven rollers while supporting the strip; and a positioner for moving the gag roll from an inoperative position remote to the passline to an operative position intercepting and deflecting the strip from the passline to tension the strip during coiling.

25. A strip tensioning and stabilizing apparatus to tightly wind strip delivered from a hot strip finishing mill on a coiler, said apparatus including:

spaced apart driven rollers for advancing strip along a passline downstream from such a hot strip finishing mill;

a gag roll for deflecting the strip from the passline between said spaced apart drive rollers;

a lower pinch roller for lifting the strip to the passline after deflection by said gag roll; and a positioner for moving the gag roll from an inoperative position remote to the passline to an operative position intercepting and deflecting the strip from the passline to tension the strip during coiling.

26. A method for coiling hot strip delivered from a train of finishing mill stands along a passline of a runout table to a coiler, said method including the steps of:

deflecting a leading end of hot strip by a pinch roll assembly while advanced along the passline to the coiler;

creating a first strip tension zone between said pinch roll assembly and a coiler mandrel of said coiler;

creating a second strip tension zone between the coiler mandrel and a gag roll, said second strip tension zone being formed by deflecting the strip relative to the pass line by engagement with the gag roll; and arranging a further gag roll to support an upper surface of the strip at the passline before deflection of the strip from the passline.

* * * * *